US005593547A

United States Patent [19]

Pisinger

[11] Patent Number: 5,593,547

[45] Date of Patent: Jan. 14, 1997

[54] PRESS SECTION OF A PAPER MACHINE

[75] Inventor: Franz Pisinger, Heidenheim, Germany

[73] Assignee: Voith Sulzer Papiermaschinen GmbH, Germany

[21] Appl. No.: 379,884

[22] Filed: Jan. 27, 1995

[30] Foreign Application Priority Data

Jan. 28, 1994 [DE] Germany ..... 44 02 513.0

[51] Int. Cl.[6] ..... D21F 3/04

[52] U.S. Cl. ..... 162/360.3; 162/358.3; 162/360.2

[58] Field of Search ..... 162/358.3, 360.3, 162/360.2

[56] References Cited

U.S. PATENT DOCUMENTS

| | | | |
|---|---|---|---|
| 2,882,968 | 4/1959 | Beachler | 162/360.3 |
| 4,197,158 | 4/1980 | Johnson | 162/360.3 |
| 4,483,745 | 11/1984 | Wicks et al. | 162/360.2 |
| 4,648,942 | 3/1987 | Wanke et al. | 162/286 |
| 5,092,962 | 3/1992 | Koski | 162/360.3 |

FOREIGN PATENT DOCUMENTS

| | | | |
|---|---|---|---|
| 2734805 | 8/1978 | Germany | 162/360.3 |
| 9206340 | 9/1992 | Germany | 162/358.3 |
| 4321404 | 11/1993 | Germany | 162/360.3 |

OTHER PUBLICATIONS

Das Papier 891H10A—Aug. 1989: P. Mirsberger, Schuhpressen zum intensiven Entwassern von Papier und Karton, pp. 130–138.

J. M. Voith GmbH; Technical data sheet; Baujahr 1971.

*Primary Examiner*—Karen M. Hastings

*Attorney, Agent, or Firm*—Ostrolenk, Faber, Gerb & Soffen, LLP

[57] ABSTRACT

Various embodiments of a press section for a paper making machine are disclosed having a first press section with two press nips defined by press rolls pressing against a first central roll followed by a second press section with two press nips defined by press rolls pressing against a second central roll. The first central roll is wrapped by a first felt which carries the web through the first and second press nips. The second central roll is unfelted. At least a single respective felt passes through each of the four press nips, and in some embodiments two felts pass through some of those press nips. At least one of the third and fourth press nips is defined by a long nip shoe press in the respective press roll. An additional press nip may be defined around either of the last press roll of the first press section or the first press section, and that additional press nip is double felted. The transfer between the first and second press sections may be an open transfer from the second press roll of the first section or it may be a supported transfer by the felt passing through the second press nip carrying the web into the third press nip.

15 Claims, 4 Drawing Sheets

PRESS SECTION OF A PAPER MACHINE

BACKGROUND OF THE INVENTION

The present invention relates to a press section of a paper machine for the dewatering of a web of paper and particularly to a press section with four press nips, or even more.

In the press section shown in Voith Prospectus No. p2813, "Schongau PM 7", page 10, four press nips are shown. The first press nip represents a twin-felt press nip. It is followed by three further single-felt press nips, which are also formed by conventional press rolls. Although this paper machine has proven successful, one disadvantage is that heavy papers and cardboard or board material cannot be produced with this press section because the water removal capacity of the four press nips is not sufficient.

SUMMARY OF THE INVENTION

It is an object of the present invention to improve the known press section to retain its excellent operating behavior while modifying it so that heavy papers and cardboard and board of good quality can also be produced. This object is achieved by the invention.

Various embodiments of a press section for a paper making machine are disclosed. Each has a first press section with two press nips each defined by a press element, in the form of a press roll, which presses against a first central roll, followed by a second press section also with two press nips each also defined by a press element which presses against a second central roll. The first central press roll is wrapped by a first felt which carries the web through the first and second press nips. The second central roll is unfelted. At least a single respective felt may pass through each of the four press nips or through only two of the nips, and in some embodiments two felts pass through some press nips.

At least one of the third and fourth press nips is defined by a long nip shoe press in the respective press roll.

An additional press nip may be defined around either of the second (in the web path) press roll of the first press section or the first press roll of the second press section and that additional press nip is double felted.

The transfer between the first and second press sections may be an open transfer from the second press roll of the first section or it may be a supported transfer by a felt passing through the second press nip and carrying the web into the third press nip.

Other features and advantages of the present invention will become apparent from the following description of the invention which refers to the accompanying drawings.

DESCRIPTION OF PREFERRED EMBODIMENTS OF THE INVENTION

Figure 1:
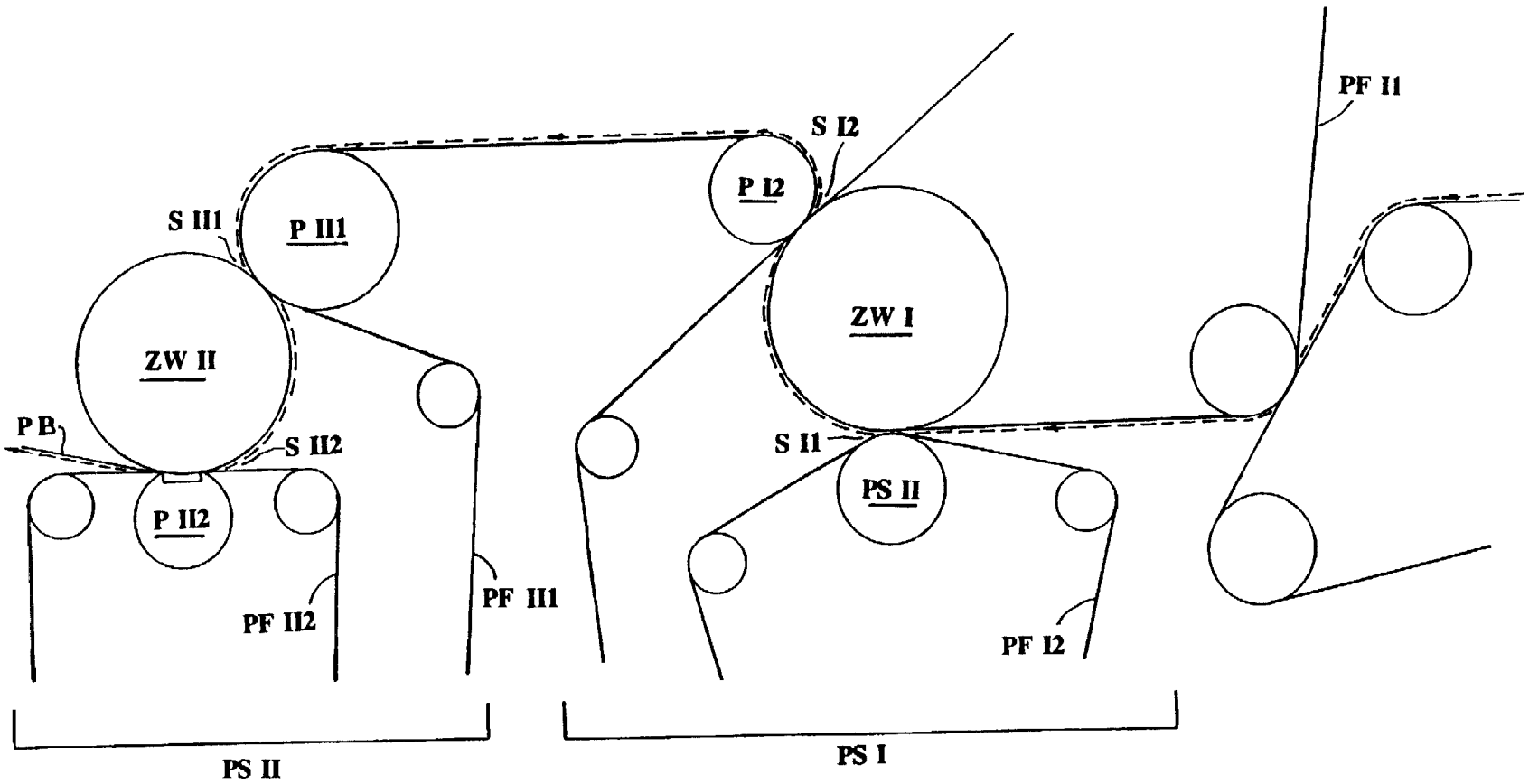
FIG. 1 schematically shows a first press section embodiment in accordance with the invention for pressing webs with one-sided smoothness.

FIG. 1 shows a first embodiment of the invention of a press section for webs with one-sided smoothness. The press section is divided into two press sections PS I and PS II. The web is transferred between the sections by a press felt which is used in both sections. The paper web PB, coming from the forming wire or forming section (from the right) is taken off the wire by a take-up roll onto the underside of a first press felt PF I1, and the web is introduced into a first press nip S I1 by the felt PF I1. This press nip is formed between a central roll ZW I and a first press element in the form of a first press roll P I1, which presses against the central roll ZW I. The first felt PF I1 wraps around the central roll ZW I.

A second lower felt PF I2 is guided to wrap around the press element P I1, forming a first double-felt press nip S I1 where the web is sandwiched between the felts PF I1 and PF I2 and where initial gentle water removal is effected.

The web PB then rests on the exterior of the press felt PF I1 and passes with that felt around the central roll ZW I into the second press nip S I2. The second press nip is defined by a felted press element in the form of a press roll P I2 and again by the felted central roll ZW I of the first press section PS I. The web is again sandwiched between the first felt PF I1 and the second felt PF II1 in the second press nip S I2. In the second nip, there is again dewatering on both sides of the web at the two felts without special smoothing of the web also taking place.

The paper web PB is now adhered to the press felt PF II1 of the second press section PS II, and the web is conducted with the second felt PF II1 to the third press nip S II1 which produces a one-sided smoothing. The third press nip is defined by a smooth surfaced, second central roll ZW II and by a press element P II1 in the form of a third press roll, which is partially wrapped by the second press felt PF II1 that extends between the first and the second press sections. Increased adherence to an unfelted roll surface causes the paper web PB to now remain with its presmoothed side adhering on the second central roll ZW II, while the second press felt PF II1 detaches itself from the web immediately after the third press nip SII1 in order to avoid rewetting. The web is thus conducted to the last press nip SII1, without having to detach itself from the surface of the roll, so that, in advantageous fashion, no web detachment which reduces the web smoothness is necessary.

In the invention, one of the last two press nips, the third or the fourth, is developed as a long nip, shoe press. In FIG. 1, the last press nip S II2 is developed as a long nip, shoe press and the press element P II2 is provided as a single-sided felted long nip, shoe press. Due to the elongated path of pressure application, particularly high web dryness is obtained, and a paper web which is very smooth on one side is produced. After the last press nip, the paper web PB is immediately detached from the press felt PF II2 and is conducted over a free path to the dryer section.

Figure 2:
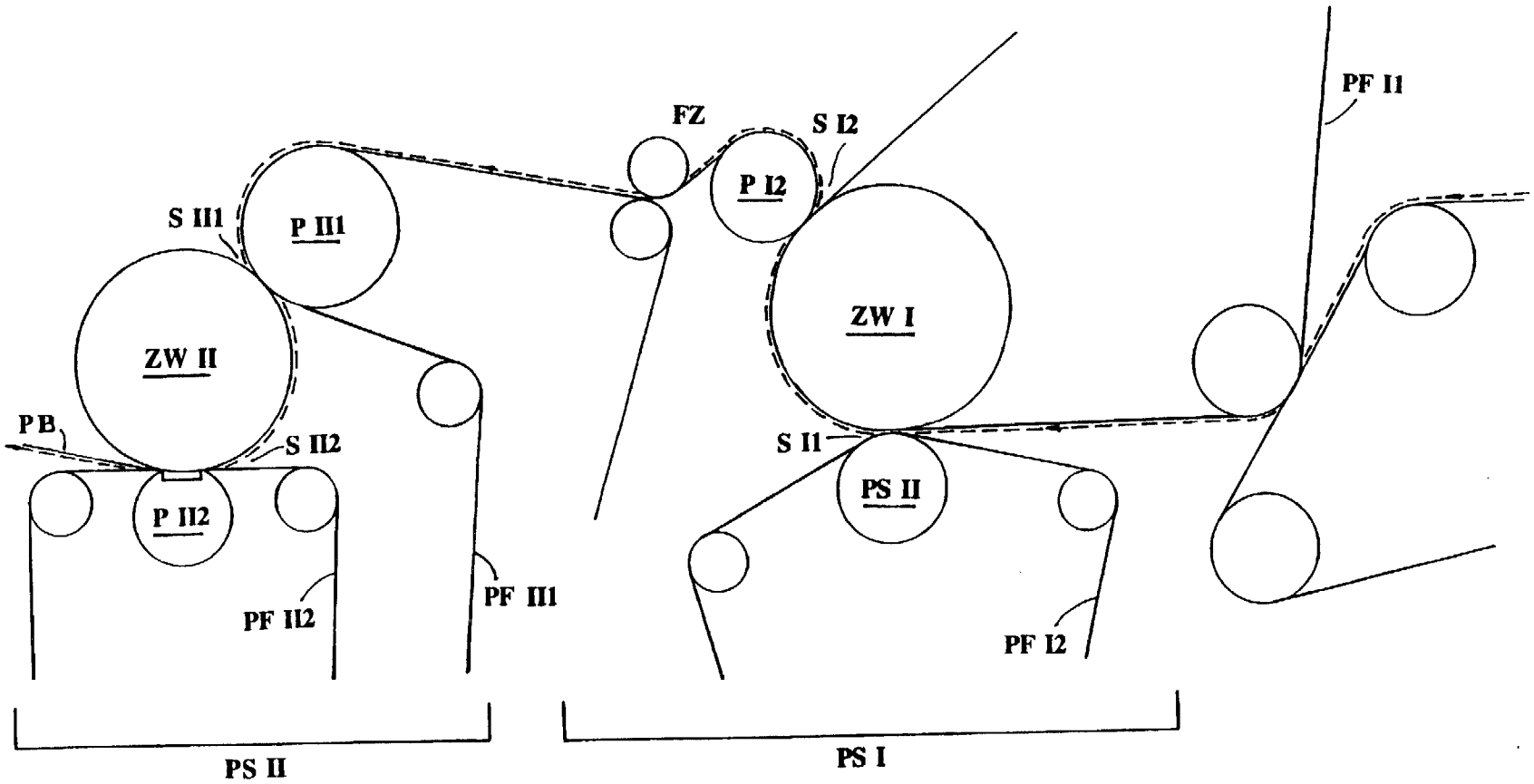
FIG. 2 schematically shows a second press section embodiment for pressing webs with two-sided smoothness.

FIG. 2 shows an embodiment in accordance with the invention of a press section which is similar to FIG. 1, but which is intended for webs with two-sided smoothness. The press section is also subdivided into two press sections PS I and PS II. After wrapping over the second press element or press roll PI 2 of the first press section PS I, the web is conducted over a free path or open draw FZ and is then transferred, by means of the first press felt PF II1, into the second press section PS II. Another essential difference is that the second press nip S I2 of the first press section PS I has only a single felt on the side of the web toward the central roll ZW I, so that a first smoothing takes place on the first side of the paper web against the roll P I2.

The paper web PB coming from the wire or forming section (from the right) is taken over, by means of a take-up roll, onto a first press felt PF I1 and is carried on the underside of the felt PF I1 and is introduced into a first press nip S I1. This press nip is formed by a central roll ZW I and a first press element P I1 in the form of a first press roll. The felt PF I1, which feeds the web PB, wraps around the central roll ZW I and forms, together with a second felt PF I2, which wraps around the first press element P I1, a first double felt press nip S I1, in which a gentle first dewatering is effected. The web PB then travels on the outside of the first press felt PF I1 as they wrap around the first central roll ZW I, and they travel into the second single felted press nip S I2, which is defined between a smooth, non-felted press roll P I2 and the felted central roll ZW I of the first press section PS I. Here, a first smoothing of the first side of the paper web takes place against the press roll PI 2.

The paper web PB is next conducted over the top of a free path or open draw FZ between the roll P I2 and a guide roll, and the web transfers at the guide roll onto the top surface of the third press felt PF II1 coming from the second section PS II. The web is conducted, together with the felt PF II1, to the first press nip S II1 of the second press section. This press nip is formed by a smooth unfelted second central roll ZW II and a press element P II1 which is in the form of a third press roll which is wrapped by the third press felt PF II1. The paper there contacts the second central roll ZW II without a felt between them, whereby the paper is smoothed on its second side. Due to increased adherence, the paper web PB remains resting with its presmoothed side on the second central roll ZW II, while the third press felt PF II1 detaches itself from the web immediately after the third press nip in order to avoid rewetting of the web. The web is thus conducted to the last press nip S II2 without having to detach itself from the supporting surface, so that, in an advantageous manner, no detachment of the web, which reduces its smoothness, is necessary.

In this embodiment also, one of the last two press nips is developed as a long nip or shoe press. The last press nip S II2 in FIG. 2 is developed as a long nip or shoe press. The press element P II2 is provided as a single-side felted long nip or shoe press. The lengthy action of the pressure produces particularly high web dryness and the embodiment of FIG. 2 produces a paper web which is smooth on both sides. The paper web PB is then immediately detached from the press felt PF II2 and is conducted over a free path to the drying section (not shown). A particular advantage of this embodiment of the press section results from the separation of the two sections I and II by the free web path FZ. As a result, in the event of a tear of the web in the second press section, the paper web can be first led away into a recirculation or discard vat at the free path and the restarting of the paper web can be commenced from there.

Figure 3:
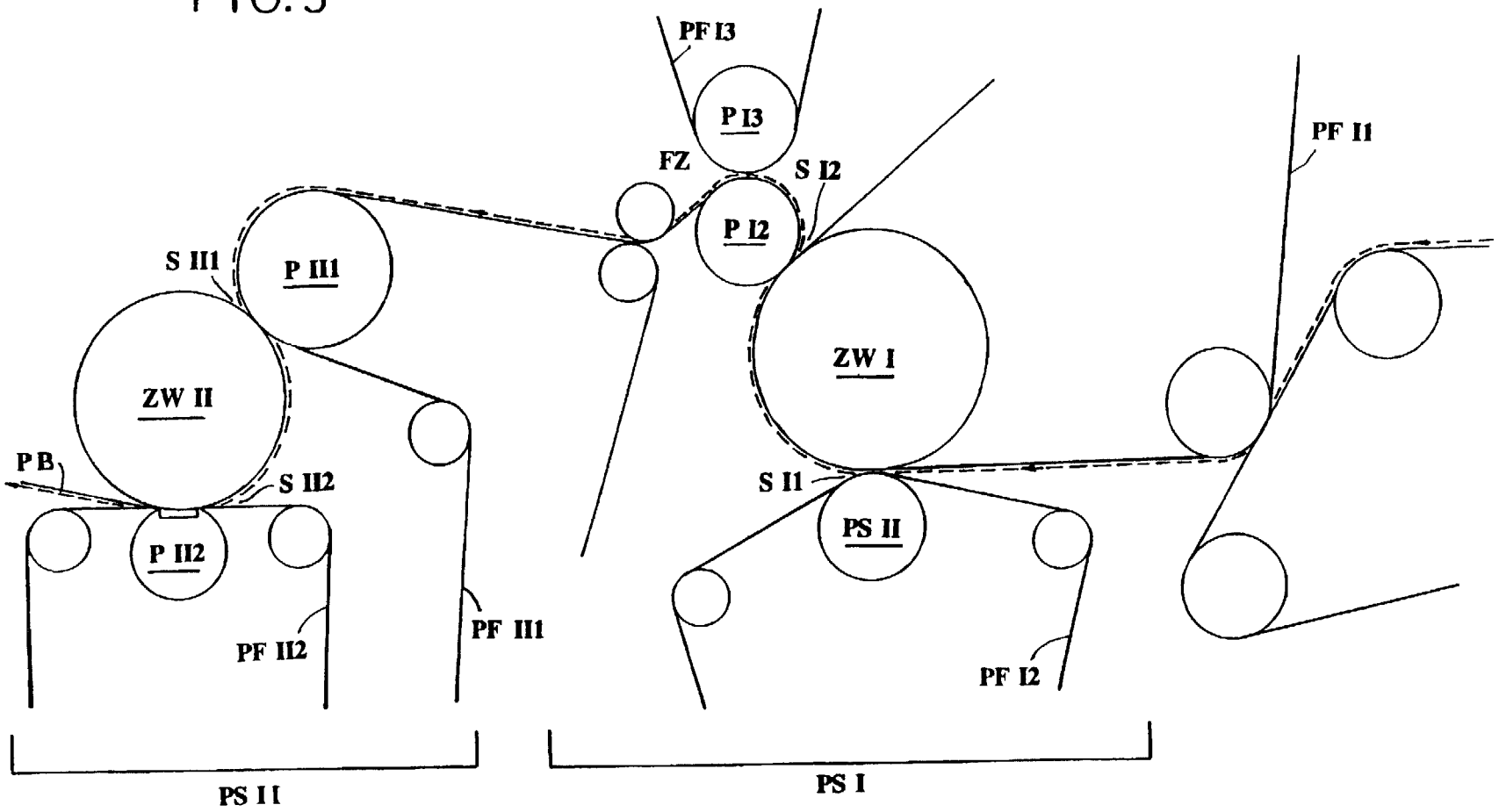
FIG. 3 shows the press section embodiment of FIG. 2 with an additional press nip in the first press section.

FIG. 3 shows a press section otherwise in accordance with FIG. 2, but in which the first press section is provided with an additional or third press nip which lies in the web path between the second press nip S I2 and the free path FZ and is developed as a single felted press nip. An additional felt PF I3 passes through that additional press nip, which makes that nip a single felted nip and the same web side is again pressed on the roll P I2 as was pressed there in the nip S I2. This development provides a very uniform smoothness of the paper web PB in an advantageous manner, because now both sides of the paper web come to rest twice on a smooth roll upon the pressing.

Figure 4:
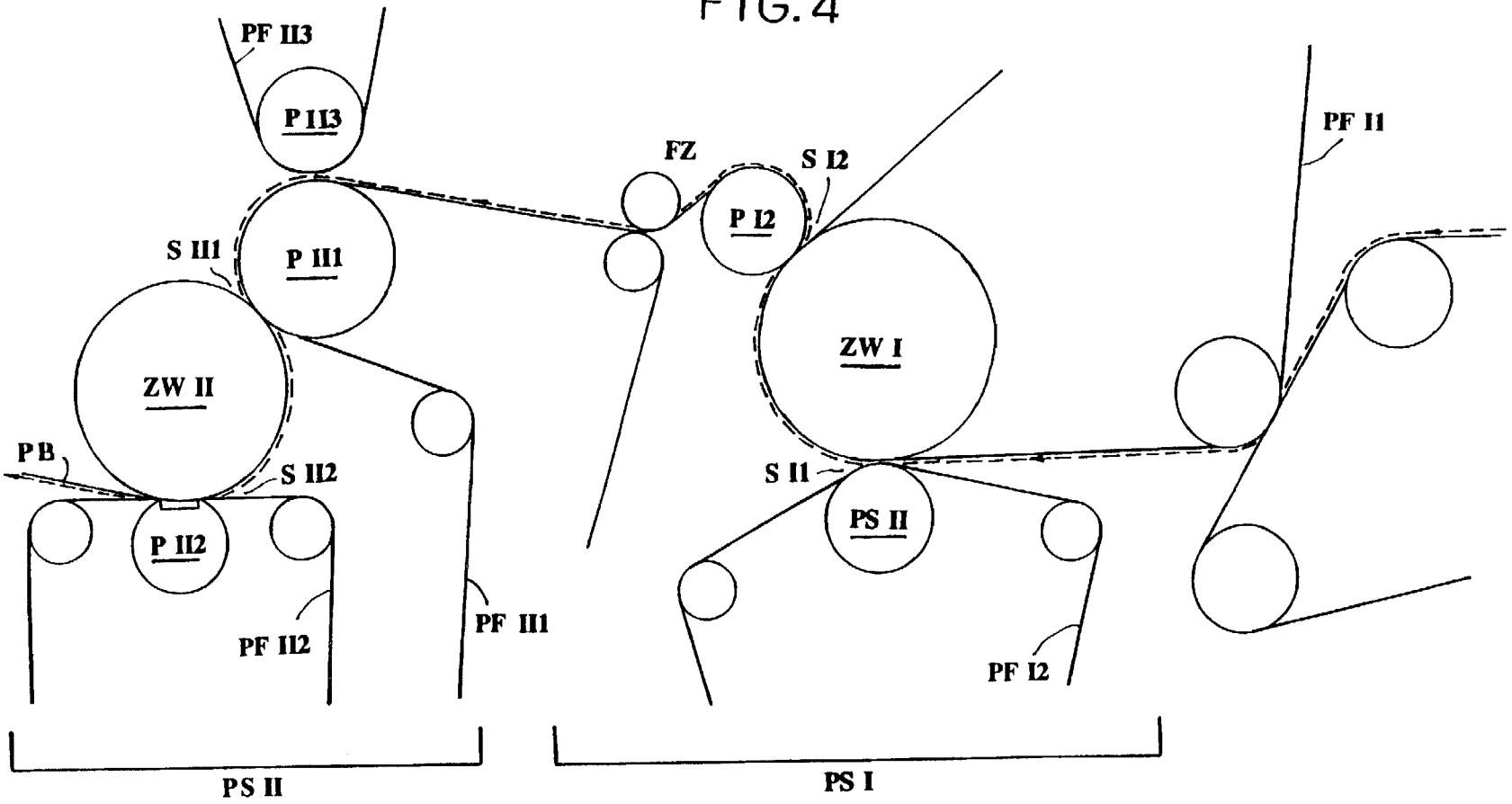
FIG. 4 shows the press section embodiment of FIG. 2 with an additional press nip in the second press section.

FIG. 4 shows the press section of FIG. 2, this time with an additional double felted press nip arranged at the start of the second press section. This double felted press nip is formed by the first press element or press roll P II1 of the second press section PS II and a further felted roll P II3. This sandwiches the web in a double-felted nip. This arrangement is particularly advantageous for extremely thick webs of paper, because it enables strong but gentle water removal to take place again. However, in contrast to the embodiment shown in FIG. 2, a paper or cardboard web with substantially single-side smoothness is produced.

A combination of the two embodiments of FIGS. 3 and 4 is also possible in accordance with the invention, i.e., the additional press roll P I3 of the first press section and the additional press roll P II3 of the second press section may both be provided.

The drawings are mere diagrams which, in order to assure a more uncluttered showing of the inventive concept, dispense with the conventional provision in a press section of suction zones, steam blow boxes, scrapers, etc., which are self evident to a person skilled in the art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press section of a paper making machine for dewatering a paper web, the press section comprising:

a first press section comprising:

a first central press roll; a first press element pressing against the first central roll for defining a first press nip; a second press element spaced from the first press nip and pressing against the first central roll for defining a second press nip;

a first press felt for supporting the web and passing through the first press nip, wrapping around the first central press roll and then passing through the second press nip and first guide means for causing the first press felt to leave the web after the second press nip;

a second press section following the first press section in the path of the web through the press section of the paper making machine, the second press section comprising:

a second central press roll which is smooth and unfelted; a third press element pressing against the second central roll for defining a third press nip located against the upper half of the second central press roll; a fourth press element spaced from the third press nip so that the fourth press element is located substantially below the second central press roll and pressing against the second central roll for defining a fourth press nip;

a second press felt in position for receiving the web from the first press section and for carrying the web into the third press nip; the second felt passing through the third press nip and forming a single felt press nip there; second guide means for guiding the second felt off the web after the third press nip, so that the web travels on and with the unfelted second central roll toward the fourth press nip;

a third press felt, third guide means for guiding the third felt through the fourth press nip and forming a single felt press nip there, and the third guide means guiding the third felt off the web after the fourth press nip;

at least one of the third and fourth press elements comprising a long nip, shoe press;

a fourth press felt passing through the first press nip at the opposite side of the web from the first felt and respective fourth guide elements for the fourth press felt for directing the fourth press felt toward and then away from the first press nip and away from the web; and wherein the first press element comprises a first rotatable press roll which presses against the first central roll and the second press element comprises a second rotatable press roll which presses against the first central roll.

2. The press section of claim 1, wherein the second press element comprises a rotatable press roll which presses against the first central roll;

a further press felt passing through the second nip and on the opposite side of the web from the first felt so that the second press nip is a double felted press nip.

3. The press section of claim 1, wherein the second guide elements for the second press felt support the second press felt of the second press section to be near to the second press element so as to define a free path open transfer of the web between the first press section and the second felt.

4. The press section of claim 3, wherein the second press element comprises a press roll pressing against the first central roll for defining the second press nip;

the first guide elements for the first felt directing the first felt off the web after passing the second press nip, and the web thereby travelling unfelted around the second press roll until the web leaves the second press roll on the free path open transfer to the second press felt.

5. The press section of claim 1, wherein the second press element comprises a second press roll pressing against the first central roll for defining the second press nip;

a fifth press element pressing against the second press roll at a location spaced from the second press nip, and the fifth press element and the second press roll forming a fifth press nip.

6. The press section of claim 5, further comprising a fifth press felt passing through the fifth press nip on the side of the web away from the second press roll.

7. The press section of claim 6, wherein the fifth press element comprises a press roll, and the fifth press felt wraps the fifth press element roll.

8. The press section of claim 1, wherein the third press element comprises a press roll pressing against the second central roll for defining the third press nip.

9. The press section of claim 1, wherein the long nip shoe press is at the fourth press nip.

10. A press section of a paper making machine for dewatering a paper web, the press section comprising:

a first press section comprising:

a first central press roll; a first press element pressing against the first central roll for defining a first press nip; a second press element spaced from the first press nip and pressing against the first central roll for defining a second press nip;

a first press felt for supporting the web and passing through the first press nip, wrapping around the first central press roll and then passing through the second press nip and first guide means for causing the first press felt to leave the web after the second press nip;

a second press section following the first press section in the path of the web through the press section of the paper making machine, the second press section comprising:

a second central press roll which is smooth and unfelted; a third press element pressing against the second central roll for defining a third press nip; a fourth press element spaced from the third press nip and pressing against the second central roll for defining a fourth press nip;

a second press felt in position for receiving the web from the first press section and for carrying the web into the third press nip; the second felt passing through the third press nip and forming a single felt press nip there; second guide means for guiding the second felt off the web after the third press nip, so that the web travels on and with the unfelted second central roll toward the fourth press nip;

a third press felt, third guide means for guiding the third felt through the fourth press nip and forming a single felt press nip there, and the third guide means guiding the third felt off the web after the fourth press nip;

at least one of the third and fourth press elements comprising a long nip, shoe press;

wherein the second press element comprises a rotatable press roll which presses against the first central roll;

a further press felt passing through the second nip and on the opposite side of the web from the first felt so that the second press nip is a double felted press nip; and wherein the further felt passing through the second press nip is the same felt as the second felt which passes through the third press nip and the second felt thereby transfers the paper web from the first press section to the second press section.

11. A press section of a paper making machine for dewatering a paper web, the press section comprising:

a first press section comprising;

a first central press roll; a first press element pressing against the first central roll for defining a first press nip; a second press element spaced from the first press nip and pressing against the first central roll for defining a second press nip;

a first press felt for supporting the web and passing through the first press nip, wrapping around the first central press roll and then passing through the second press nip and first guide means for causing the first press felt to leave the web after the second press nip;

a second press section following the first press section in the path of the web through the press section of the paper making machine, the second press section comprising:

a second central press roll which is smooth and unfelted; a third press element pressing against the second central roll for defining a third press nip; a fourth press element spaced from the third press nip and pressing against the second central roll for defining a fourth press nip;

a second press felt in position for receiving the web from the first press section and for carrying the web into the third press nip; the second felt passing through the third press nip and forming a single felt press nip there; second guide means for guiding the second felt off the web after the third press nip, so that the web travels on and with the unfelted second central roll toward the fourth press nip;

a third press felt, third guide means for guiding the third felt through the fourth press nip and forming a single felt press nip there, and the third guide means guiding the third felt off the web after the fourth press nip;

at least one of the third and fourth press elements comprising a long nip, shoe press;

wherein the third press element comprises a press roll pressing against the second central roll for defining the third press nip; and further comprising a fifth press element pressing against the third press roll at a location away from the third press nip for defining a fifth press nip between the fifth press element and the third press roll, and the second felt being guided to pass through the fifth press nip.

12. The press section of claim 11, further comprising a fourth press felt passing through the fifth press nip on the opposite side of the web from the second press felt.

13. The press section of claim 12, wherein the fifth press element comprises a rotatable press roll and the fourth felt wraps the fifth press element roll.

14. The press section of claim 12, wherein the long nip shoe press is at the fourth press nip.

15. The press section of claim 11, further comprising a fifth press felt passing through the first press nip at the opposite side of the web from the first felt and respective guide elements in the fifth press felt for directing the fifth press toward and then away from the first press nip.

* * * * *